United States Patent [19]

Frascatore et al.

[11] 4,416,499

[45] Nov. 22, 1983

[54] ELECTRICAL CONNECTOR ASSEMBLY

[75] Inventors: John F. Frascatore, Unadilla; Dean R. Nelson, Sidney, both of N.Y.; Edward K. Marsh, Orlando, Fla.

[73] Assignee: The Bendix Corporation, Southfield, Mich.

[21] Appl. No.: 313,566

[22] Filed: Oct. 22, 1981

[51] Int. Cl.[3] ..... H01R 13/22

[52] U.S. Cl. ..... 339/92 M; 339/49 B; 339/205

[58] Field of Search ..... 339/47 R, 48, 49, 75 M, 339/93, 205, 92 M

[56] References Cited

U.S. PATENT DOCUMENTS

| | | | |
|---|---|---|---|
| 2,963,677 | 12/1960 | Kallenborn | 339/48 |
| 3,157,448 | 11/1964 | Crimmins et al. | 339/49 |
| 3,258,733 | 6/1966 | Elm | 339/98 |
| 3,383,644 | 5/1968 | Nava et al. | 339/205 |
| 3,548,367 | 12/1970 | Bruetsch | 339/205 |
| 3,605,068 | 9/1971 | Rayburn | 339/49 |
| 3,611,270 | 10/1971 | Eppler | 339/176 |
| 4,018,496 | 4/1977 | Bilsback | 339/17 F |
| 4,062,615 | 12/1977 | Navarro | 339/98 |
| 4,230,389 | 10/1980 | Kotski | 339/49 R |

FOREIGN PATENT DOCUMENTS

| | | | |
|---|---|---|---|
| 1221836 | 6/1960 | France | 339/49 R |
| 1280477 | 7/1972 | United Kingdom | 339/47 R |

*Primary Examiner*—John McQuade

*Attorney, Agent, or Firm*—John R. Benefiel; Raymond J. Eifler

[57] ABSTRACT

An electrical connector assembly (10) consisting of a cover (12) and a base (14) adapted to be interfit and secured together, with the base (14) carrying groove contacts (64) and the cover (12) pin shaped sleeve contacts (68), each positioned within a groove contact (64) upon assembly of the cover (12) and (base) to create the electrical connections. The electrical connection from the lead (20) to the groove contact 64 is also established by sleeve contacts (58) assembled into the base to overlie one end of the groove contact (64). A compression pad (34) carried by the cover (12) exerts a spring force on the sleeves contacts (58) and (68) upon assembly.

7 Claims, 4 Drawing Figures

ELECTRICAL CONNECTOR ASSEMBLY

This invention relates to electrical connector assemblies. Electrical connector assemblies are employed in order to provide ready making and breaking of electrical connections, such as to connect the leads of a cable into a printed circuit board. The typical connector includes a housing within which are mounted contacts brought into mating engagement with the contacts of a mating connector upon assembly of the connectors together. Each of the contacts in turn are electrically connected to the respective circuit leads.

A great many designs for such connectors have been developed over the years, each adapted to various requirements of a particular application. In instances in which the connector is to establish a great number of electrical connections, space requirements for the connector contacts become excessive. For such applications, in order to provide a reasonably sized connector, the contacts of the connector of necessity must be very closely spaced. Considerable difficulty may be encountered in providing such close spacing between the contacts while maintaining a reliable electrical connection between the mating contacts.

In addition, the large number of mating contacts may require an excessive insertion force. That is, the force necessary to join two mating electrical connectors carrying the large number of contacts.

In any design of an electrical connector, it is also highly desirable that a relatively simple configuration be employed to allow low cost manufacture, and to simplify the assembly of the connector components.

Prior art attempts at providing connectors with very closely spaced contacts have not entirely satisfactorily met these demands.

DISCLOSURE OF THE INVENTION

The present invention provides an electrical connector assembly with very closely spaced contacts, so as to enable the connection and disconnection of a large number of electrical leads with a connector of relatively compact size. The electrical connector assembly according to the present invention consists of two basic components, a base, which carries a series of groove contacts; and a cover, which is adapted to be interfit with the base and secured together therewith. Pin shaped sleeve contacts installed within the cover are brought into engagement with respective groove contacts to establish the appropriate electrical connections upon assembly of the base and cover.

A compression pad is carried by the cover and applies a pressure tending to increase the contact force between the cover contacts and groove contacts.

An advantage of the electrical connector assembly according to the present invention is that it enables a very close spacing of the contacts which allows a relatively compact connector.

At the same time the connector assembly has the advantage of a relatively simple construction, while providing a relatively large contacting area, resulting in low contact resistance.

Another advantage is that size and location variations of the contact sleeves may be accommodated by the groove geometry, to also provide the advantage of reliable connections notwithstanding relatively close contact spacings.

DETAILED DESCRIPTION OF THE INVENTION

Figure 1:
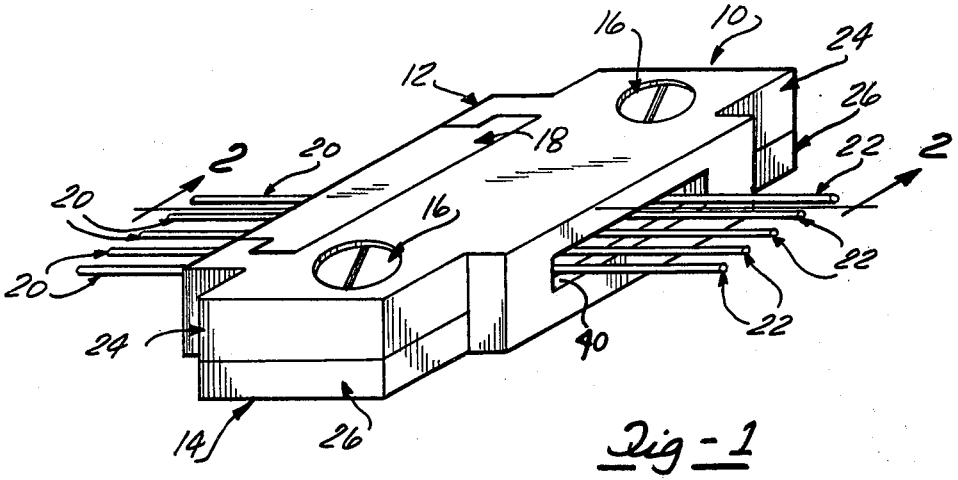
FIG. 1 is a perspective view of an electrical connector assembly according to the present invention, including a fragmentary view of the connected leads.

Referring to the drawings, and particularly FIG. 1, the disclosed embodiment of the electrical connector assembly 10 according to the present invention includes a pair of housing members, a cover 12, and a base 14, each of a suitable electrical insulating material such as molded plastic. The base 14 and cover are configured to be interfit, and held compressed together by screws 16 (FIG. 2) extending through the outer face of the top cover 12 and bottom cover 14 secured by nuts 17. The screws 16 each pass through outer projections 24 of the cover 12 and projections 26 of the base 14.

A keying projection 18 is carried by the base 14 to prevent mismatching of the base 14 and cover 12.

Circuit leads 20 extend into one end of the base 14 while the leads 22 to be connected thereto extend into the opposite end of the cover 12.

Figure 2:
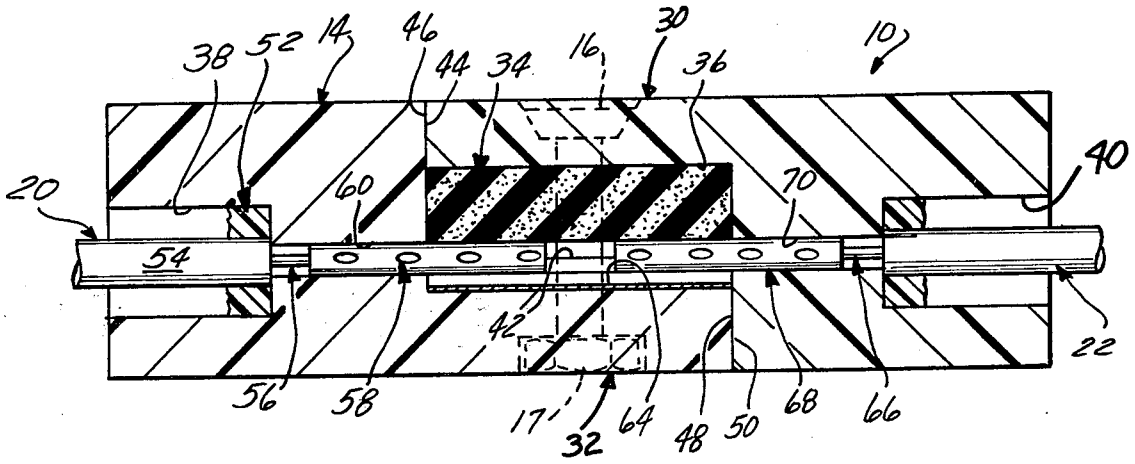
FIG. 2 is a lengthwise sectional view of the electrical connector assembly shown in FIG. 1.

Referring to FIG. 2, it can be seen that the base 14 and the cover 12 have interfit portions 30 and 32 which are respectively formed with relief surfaces 44 and 48 such as to form a pair of transversely extending opposing surfaces 36 and 42, with a cavity therebetween with the base 14 and cover 12 assembled together. This cavity is occupied by a compression pad 34, constructed of a suitable electrically insulating resilient material such as an elastomeric foam. The compression pad 34 is cemented to be affixed to the opposing surface 36 of interfit portion 30, so as to be carried by the cover 12.

Leads 20 of the base 14 pass into a recess 38 of the base 14, and leads 22 extend into recess 40 of the cover 12.

Compression pad 34 is adapted to overlie the under surface 42 of the interfit portion 32 of the base 14.

The base 14 relief surface 44 forms an abutment against which the leading surface 46 of the interfit portion 30 of the cover 12 is located, with the cover 12 and the base 14 assembled.

The cover 12 relief surface 48, also forms an abutment with the end surface 50 of the interfit portion 32 of the base 14 located thereagainst with the base 14 and cover 12 assembled.

The screws 16 and nuts provide a means for compressing together the interfit portion 30 and 32 respectively with the compression pad 34 between opposed surfaces 36 and 42, such as to cause a compression of the compression pad 34 at assembly.

Referring again to FIG. 2, the leads 20 are disposed within a recess 38 and maintained in position by a reflow material mass 52.

Figure 3:
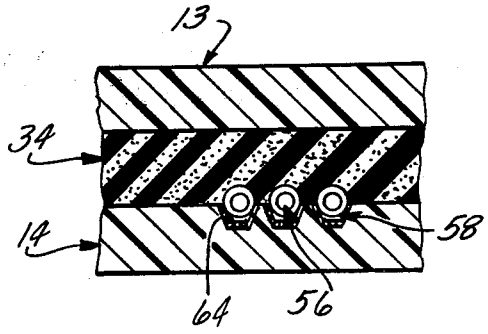
FIG. 3 is a fragmentary sectional view taken transversely to the contacts of the electrical connector shown in FIGS. 1 and 2.

To connect leads 20, the insulation 54 of the lead 20 is stripped to expose the central conductor 56, which in turn is crimped or soldered to a sleeve 58. The sleeve 58 is inserted in a through passage 60 formed in the base 14, and disposed to protrude into the region above the opposing surface 42. The opposing surface 42 is formed with a series of parallel, elongated generally Vee shaped elements constituted by grooves 62 as shown in FIG. 3, each aligned with one of the passages 60, such as to dispose each of the sleeves 58 within a respective V groove 62.

Each of the sleeves 58 are preferably formed from a low resistance contact material, such as plated copper alloy, which is crimped onto the bare conductor 56. Each of the grooves 62 is covered with a conductive metallic metalization such as gold over nickel applied by screen printing or other deposition process, to form a groove contact 64.

An electrical connection is thereby established between each sleeve 58 and its respective groove contact 64.

Each of the leads 22 is also stripped of its insulation at its terminal end to bare the central conductor 66 and a pin-shaped contact consisting of a contact sleeve 68 crimped, soldered, or otherwise affixed thereto. Each of the sleeve contacts 68 are disposed within through passages 70 formed in the cover 12 and located such that the projecting sleeve contacts 68 will be laterally advanced to be just interfit within a respective one of each of the groove contacts 64 when the base 14 and cover 12 are assembled together.

Figure 4:
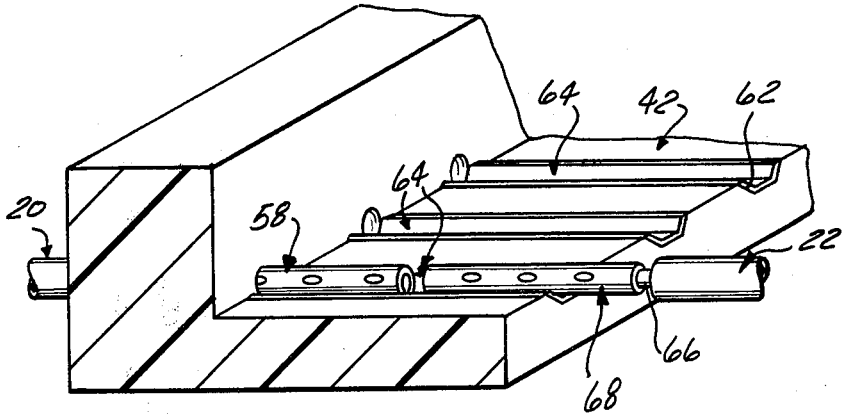
FIG. 4 is a fragmentary perspective view of certain of the electrical connector assembly components showing the contact sleeves disposed within the groove contacts.

This relationship is best seen in FIG. 4 which shows a typical sleeve contact 68 and sleeve 58 each in contact with a groove contact 64 of the base 14. Electrical contact is thus established between the sleeve 58 and sleeve contact 68 via the groove contact 64, thereby connecting electrically the conductors 66 and 56 of the leads 22 and 20, respectively.

The compression pad 34 is caused to be compressed by the assembly of the base 14 and cover 12 upon installation of the screws 16 and nuts 17 such as to establish a constantly applied spring force exerted atop each of the sleeves 58 and 68 insuring that good contact therebetween is established and maintained.

Each of the groove contacts 64 is adapted to accept the mating sleeve 68 of the cover 12, with the V groove geometry enabling some variation in the size of the sleeve 58 while still reliably allowing the establishment of the contact and the resulting electrical connection.

The nature of the contact, i.e., the interfitting of the sleeves 58 and 68 with the groove contact 64 affords low contact resistance by virtue of the large contact area.

Accordingly, it can be appreciated that this design allows very compact spacing of the contacts. For example a spacing on the order of 0.65 mm center to center is easily possible. The construction of the connector assembly is relatively simple, the force necessary for connection low, and the connector should operate reliably to maintain and establish each of the electrical connections.

Many variations are of course possible such as the connection of either discrete wires or flat cable.

We claim:

1. An electrical connector assembly for establishing an electrical connection between a plurality of electrical leads comprising:

a cover;

a base;

each of said cover and base being configured with portions adapted to be interfit together upon assembly of said cover and base;

means for releasably retaining said cover and base together;

each of said interfit portions having opposing surfaces formed thereon;

said base bearing a plurality electrically conductive, parallel groove contacts, extending thereacross; each of said groove contacts electrically connected to a respective one of some of said leads, each of said plurality of groove contacts consisting of an elongated generally Vee shaped element;

a plurality of pin shaped contacts carried by said cover each configured and located to be advanced laterally onto a respective one of said groove contacts by interfitting of said cover and base portions, each of said pin shaped contacts adapted to be electrically connected to a respective one of the remainder of said leads, whereby an electrical connection therebetween may be established upon interfitting of said cover and base portions.

2. The electrical connector assembly according to claim 1 further including a compression pad overlying said plurality of pin shaped contacts, upon assembly of the cover and base to insure good contact pressure of said pin shaped contacts within the respective groove contacts.

3. The electrical connector assembly according to claim 2 wherein said resilient compression pad is disposed between said interfit portions of said cover and base and is adapted to engage each of said pin shaped contacts to increase the contact pressure.

4. The electrical connector assembly according to claim 1 wherein each of said plurality of groove contacts is electrically connected to a respective one of some of said leads by a sleeve carried by said base and extending into a portion of said vee-shaped element of the connected groove contact.

5. The electrical connector assembly according to claim 1 wherein said cover is formed with a relief surface and said base is formed with a relief surface, to thereby form said interfitting portions thereof, and wherein said cover is formed with a series of through passages within which a respective one of said pin shaped contacts are disposed, extending onto said relief surface of said cover and through which each of said pin shaped contacts protrude.

6. The electrical connector assembly according to claim 5 wherein said base is formed with a series of through passages extending in alignment with a respective one of each of said groove contacts, and wherein each of said groove contacts is electrically connected to a respective lead by a sleeve disposed in each through passage formed in said base and protruding onto said relief surface of said base and lying within a respective one of said groove contacts in said series.

7. The electrical connector assembly according to claim 1 wherein each of said plurality of pin shaped contacts comprises a conductive sleeve adapted to receive a lead to be connected by said electrical connector assembly and affixed thereto, said sleeve being configured to lie within a respective one of said plurality of groove contacts.

* * * * *